US005737670A

United States Patent [19]

Ikegawa

[11] Patent Number: 5,737,670

[45] Date of Patent: Apr. 7, 1998

[54] FORMING METHOD AND APPARATUS

[75] Inventor: Akihito Ikegawa, Sakai, Japan

[73] Assignee: Minolta Co., Ltd., Osaka, Japan

[21] Appl. No.: 415,339

[22] Filed: Mar. 29, 1995

Related U.S. Application Data

[63] Continuation of Ser. No. 88,108, Jul. 8, 1993, abandoned, which is a continuation of Ser. No. 697,425, May 9, 1991, abandoned.

[30] Foreign Application Priority Data

| | | | |
|---|---|---|---|
| May 12, 1990 | [JP] | Japan | 2-122537 |
| Jun. 29, 1990 | [JP] | Japan | 2-171685 |
| Jun. 29, 1990 | [JP] | Japan | 2-171686 |

[51] Int. Cl.[6] ..... G03G 15/30

[52] U.S. Cl. ..... 399/149; 399/174; 399/222; 399/284

[58] Field of Search ..... 355/200, 210, 355/211, 215, 219, 245, 250, 251, 253, 260, 269, 270, 228, 229, 271; 118/653; 347/111, 112, 129; 430/120, 110, 111, 903, 904; 399/174, 175, 176, 148, 149, 150, 222, 252, 265, 279, 284, 286, 159

[56] References Cited

U.S. PATENT DOCUMENTS

| | | | |
|---|---|---|---|
| 4,469,435 | 9/1984 | Nosaki et al. . | |
| 4,488,802 | 12/1984 | Sunaga et al. . | |
| 4,533,232 | 8/1985 | Fujimura et al. . | |
| 4,554,233 | 11/1985 | Hashimoto et al. | 430/110 X |
| 4,598,993 | 7/1986 | Mizutani et al. . | |
| 4,664,504 | 5/1987 | Oda et al. . | |
| 4,666,801 | 5/1987 | Kimura et al. | 430/120 X |
| 4,684,228 | 8/1987 | Holthusen . | |
| 4,727,395 | 2/1988 | Oda et al. . | |
| 4,761,709 | 8/1988 | Ewing et al. . | |
| 4,769,676 | 9/1988 | Mukai et al. . | |
| 4,791,882 | 12/1988 | Enouguchi et al. . | |
| 4,829,335 | 5/1989 | Kanemitsu et al. . | |
| 4,843,424 | 6/1989 | Oda et al. . | |
| 4,862,209 | 8/1989 | Sakamoto et al. . | |
| 4,929,981 | 5/1990 | Kubo et al. . | |
| 4,931,876 | 6/1990 | Hashizume . | |
| 4,999,272 | 3/1991 | Tanikawa et al. | 430/903 X |
| 5,009,973 | 4/1991 | Yoshida | 430/111 X |
| 5,023,666 | 6/1991 | Shimazaki et al. . | |
| 5,035,197 | 7/1991 | Enoguchi et al. . | |
| 5,055,424 | 10/1991 | Fushimi . | |
| 5,060,016 | 10/1991 | Wanou et al. . | |
| 5,062,385 | 11/1991 | Nishio et al. . | |
| 5,066,982 | 11/1991 | Hosoya et al. . | |
| 5,075,729 | 12/1991 | Hayashi et al. . | |
| 5,148,219 | 9/1992 | Kohyama . | |

FOREIGN PATENT DOCUMENTS

| | | |
|---|---|---|
| 53-85142 | of 1978 | Japan . |
| 56-143477 | 11/1981 | Japan . |
| 59-86080 | 5/1984 | Japan . |
| 60-59592 | 12/1985 | Japan . |
| 61-42669 | 3/1986 | Japan . |
| 64-20587 | 1/1989 | Japan . |
| 1248177 | 10/1989 | Japan . |

*Primary Examiner*—Sandra L. Brase
*Attorney, Agent, or Firm*—Burns, Doane, Swecker & Mathis, LLP

[57] ABSTRACT

An image formation is conducted in such a manner that an image exposure is applied to a photosensitive member having a surface charged by the charger to form an electrostatic latent image, which is developed by a developing device into a visible image, and the visible image is transferred to a recording material. In this image formation, the above developing device is constructed to include a developer carrying member to which a developing bias voltage is applied. The developer carrying member has a surface, which carries one-component developer and is adapted to move while contacting the photosensitive member, and is operable to remove residual developer on the photosensitive member after the transferring.

48 Claims, 11 Drawing Sheets

FORMING METHOD AND APPARATUS

This application is a continuation of application Ser. No. 08/088,108, filed Jul. 8, 1993, abandoned, which is a continuation of application Ser. No. 07/697,425, filed May 9, 1991 now abandoned.

BACKGROUND OF THE INVENTION

1. Field of the Invention

The present invention relates to an electrophotographic image forming apparatus such as printers and copying machines, and to an electrophotographic image forming method.

2. Description of the Related Art

In an electrophotographic image formation of the prior art, a charger charges an outer surface of an electrostatic latent image carrier to a predetermined potential, and an image exposure corresponding to an image is applied to the electrostatic latent image carrier, so that the electrostatic latent image formed on the image carrier is developed by a developing device into a visible image, which is transferred to a recording medium and is fixed.

In this processing, developer on the electrostatic latent image carrier is not fully transferred to the recording medium, and a transfer efficiency is usually about 80–90%, which means that about 10–20% of the developer is not transferred and remains thereon. This residual developer is generally removed by a cleaning device.

There have been cleaning devices of several types such as web sliding type, fur brush type, roller type and blade type.

However, the prior art cleaning devices have following disadvantages.

(a) Existence of the cleaning device restricts reduction of sizes and cost of the image forming apparatus.

(b) If the apparatus is designed to discard the removed developer, there is a great loss of the developer, and if it is designed to reuse the developer, means for returning it to the developing device is additionally required.

(c) In either case that the developer is discarded or returned to the developing device, a container for temporarily collecting the removed developer and a space for mounting it are required, which increases sizes of the image forming apparatus.

(d) A cleaning member causes wear of a surface of the electrostatic latent image carrier due to contact therebetween, resulting in reduction of durability of the carrier.

In order to solve the problems relating to the cleaning devices described above, it has been proposed to collect the residual developer by the developing device, as disclosed in U.S. Pat. No. 4,769,676 and Japanese Laid-Open Patent Publication No. 64-20587 (20587/1989). However, simultaneous developing and cleaning processes cause following disadvantages.

(a) Developer having a small particle diameter, i.e., toner particles having a volume mean particle diameter in a range of about 3–15 μm, cannot be sufficiently removed.

(b) As the image formation process is repeated, it becomes difficult to remove spent toner which has been fused and stuck onto the surface of the electrostatic latent image carrier. This is due to a fact that a physical force enough for scraping off the spent toner does not act.

(c) Before the residual developer reaches the developing device, the electrostatic latent image carrier is charged again and subsequently the image exposure is performed. However, the residual developer still remaining during the exposure may inevitably cause defective exposure and generation of an unpreferable image memory, which deteriorates copying quality.

Further, U.S. Pat. No. 4,469,435 has taught simultaneous charging and cleaning for removing residual developer in a brush roller charger. In this prior art, durability of the charging brush roller is reduced, and the toner sticks to the brush in a spent form so that the electrostatic latent image carrier is defectively charged, resulting in deterioration of the copying quality. Further, since there is provided means for removing the residual developer which has been collected on the charging brush roller, this prior art does not necessarily contribute to reduce the sizes of the image forming apparatus and the cost thereof.

SUMMARY OF THE INVENTION

Accordingly, it is an object of the invention to provide image forming method and apparatus in which a conventional cleaning device can be eliminated, while allowing sufficient removal of residual developer, and to provide a process cartridge for these method and apparatus.

It is another object of the invention to provide image forming method and apparatus, in which, in spite of a fact that the conventional independent cleaning device is eliminated, sticking of spent developer onto an electrostatic latent image carrier and charging means, and thus deterioration thereof can be effectively prevented as compared with a case in which the conventional simultaneous development/cleaning and simultaneous charging/cleaning are employed, and also to provide a process cartridge for the same.

It is still another object of the invention to provide image forming method and apparatus, in which, in spite of a fact that the conventional independent cleaning device is eliminated, defective exposure by residual developer and generation of an unpreferable image memory can be effectively avoided as compared with a case in which the conventional simultaneous development/cleaning are employed, and also to provide a process cartridge for the same.

According to the invention, there is provided an image forming apparatus wherein an electrostatic latent image carrier circulates sequentially along a charging station, a latent image forming station, developing station and a transferring station in this order, and returns to said charging station without passing a cleaning station to form a toner image on a recording medium, comprising:

said electrostatic latent image carrier circulating along said charging, latent image forming, developing and transferring stations;

charging means provided in said charging station for charging a surface of said carrier to a predetermined potential;

latent image forming means provided in said electrostatic latent image forming station for selectively removing charges in said charged surface of said carrier to form an electrostatic latent image;

developing means provided in said developing station for selectively sticking toner particles to said electrostatic latent image, said developing means including a toner carrying member which contacts said surface of said carrier carrying said electrostatic latent image with said toner particles through a nip of a predetermined width, said toner carrying member being operable to selectively stick said toner particles to said electrostatic latent image on said electrostatic latent image carrier and to collect residual toner on said electrostatic latent image carrier; and transferring means provided in said transferring station for transferring said toner particles selectively stuck to said electrostatic latent image carrier to said recording medium.

In the above developing means, since a thin layer of the toner on the toner carrying member is brought into contact with the electrostatic latent image carrier, a scraping effect for collecting the residual developer on the carrier to the toner carrying member can be expected and also an attractive force by the toner carrying member can be expected to increase, owing to a proximity electrode effect.

The charging means may be a contact charger which contacts the said surface of said electrostatic latent image carrier for charging. Further, the charging means may be formed of a large number of brush hairs which slide on the surface of said electrostatic latent image carrier as said carrier moves and means for applying voltage to said brush hairs, so that said brush hairs may be operable to apply a predetermined voltage to said surface of said electrostatic latent image carrier and to clean said surface, owing to the brushing action.

The toner carrying member in the developing means may be operable to form a thin layer of said toner particles thereon and to bring said layer of toner particles into contact with said electrostatic latent image carrier through said nip width of 1 mm or more, and preferably 1.5 mm or more.

In this case, the thin layer of the toner on the toner carrying member may have a thickness in a range of nearly 3–100 μm, preferably 15–60 μm and more preferably 20–40 μm, if a particle diameter of the toner has a minimum value of about 3 μm. The thickness above 100 μm will reduce a shearing force for scraping off the residual toner (including spent toner) on the electrostatic latent image carrier. Further, in the above case, said particle diameter of the toner should have a maximum value of about 15 μm. The image quality may be deteriorated if the diamter exceeds the value of 15 μm. The developer used in the invention may be one-component developer mainly formed of toner particles. The toner particles may contain at least one kind of fluidization agent, at about 0.1–5 wt %, selected from a group including silica, alumina, titanium oxide, vinylidene fluoride, fluororesin and polyethylene. The rate below 0.1 wt % will hardly achieve the effect by the fluidization agent, and the rate above 5 wt % will reduce the scraping effect for the residual toner and others on the electrostatic latent image carrier. The developer used in the invention may be non-magnetic toner.

The electrostatic latent image forming means may be adapted to form said electrostatic latent image formed of an image part to which said toner particles stick and a non-image part from which said toner particles are collected to said toner carrying member. The developing means may be adapted to charge the toner particles to a predetermined polarity prior to carrying of said toner particles by said toner carrying member and to form an electric field between said toner carrying member and said electrostatic latent image carrier, said electric field being operable to apply to the charged toner particles in said image part a coulomb force in a direction from said toner carrying member to said electrostatic latent image carrier and to apply to said particles in said non-image part a coulomb force in a direction opposite to said direction.

Further, said electrostatic latent image forming means may contain a toner layer thickness controlling means for forming a thin toner film layer having a uniform thickness on said toner carrying member. The toner layer thickness controlling means may be adapted to restrict said toner layer thickness in a range from 3 μm to 100 μm, preferably 15–60 μm and more preferably 20–40 μm as described above.

In the developing means, the absolute value of the potential difference V1 for sticking the toner particles to the electrostatic latent image on electrostatic latent image carrier may be in a range from |100|V to |400|V, and the absolute value of the potential difference for collecting the residual toner may be one to four times as large as the above difference V1.

The coulomb forces caused by said developing means may have such a relationship that a ratio of an absolute value of said coulomb force generated in said image part to an absolute value of said coulomb force generated in said non-image part is in a range from 1:1 to 1:4.

As a specific example, the toner carrying member is formed of:

a cylindrical rotary roller opposed to said electrostatic latent image carrier;

a sleeve fitted around an outer surface of said rotary roller and having a peripheral length slightly longer than a peripheral length of said rotary roller, said sleeve carrying a thin toner layer thereon; and a member for pressing said sleeve against said rotary roller together to form a slack, said sleeve being driven by said rotary roller owing to friction therebetween, and said slack formed by said member being located opposite to said electrostatic latent image carrier.

Further, according to another aspect of the invention, there is provided a process cartridge used in and removably attached to an image forming apparatus including an electrostatic latent image carrier on which an electrostatic latent image is formed, comprising;

a charging brush, which is located in contact with a surface of said electrostatic latent image carrier when said process cartridge is attached to said image forming apparatus, for charging said electrostatic latent image carrier; and developing means which is located opposite to said surface of said electrostatic latent image carrier when said process cartridge is attached to said image forming apparatus.

The image forming apparatus may have a power supply for applying a voltage to said charging brush, and the cartridge may have a terminal for electrically connecting said charging brush to said power supply so as to obtain a power from said supply when said cartridge is attached to said image forming apparatus.

The image forming apparatus may include means capable of moving said surface of said electrostatic latent image carrier from said charging brush toward said developing means when said process cartridge is attached thereto.

The image forming apparatus may be provided with means which is operable, at a location between said charging brush and said developing means, to selectively remove charges from said surface of said electrostatic latent image carrier charged by said charging brush, when said moving means moves said electrostatic latent image carrier, so as to form said electrostatic latent image.

The developing means may include a toner carrying member for contacting toner particles with said surface of said electrostatic latent image carrier carrying said electrostatic latent image through a nip of a predetermined width, and said toner carrying member may be operable to selectively stick said toner particles to said electrostatic latent image on said electrostatic latent image carrier and to collect residual toner on said electrostatic latent image carrier.

The developing means may have means for supplying said toner to said surface of said toner carrying member, and means for forming a thin film layer of the supplied toner on said surface of said toner carrying member.

The developing means in this aspect of the invention may employ conditions such as a nip width, a thickness of a toner layer on the toner carrying member, type and amount of fluidization agent contained in the toner particles and a potential difference for the development of the electrostatic latent image and collection of the toner, which are same as those in the image forming apparatus described before.

Further, according to still another aspect of the invention, there is provided an image forming apparatus wherein an electrostatic latent image carrier circulates sequentially along a charging station, a latent image forming station, developing station and a transferring station in this order, and returns to said charging station without passing a cleaning station to form a toner image on a recording medium, comprising:

said electrostatic latent image carrier, which circulates along said charging, latent image forming, developing and transferring stations, and has an outer surface having photoconductivity and an inner surface which has characteristics allowing transmission of rays of light having a wavelength which allows the photoconductivity to be exhibited by said outer surface;

charging means provided in said charging station for charging said outer surface of said carrier to a predetermined potential;

latent image forming means provided in said electrostatic latent image forming station for forming said electrostatic latent image on said outer surface by irradiating rays of light in a wavelength range which allows the photoconductivity to be exhibited by said outer surface from said inner surface of said electrostatic latent image carrier;

developing means provided in said developing station for selectively sticking toner particles to said electrostatic latent image; and transferring means provided in said transferring station for transferring said toner particles selectively stuck to said electrostatic latent image carrier to said recording medium.

Also in this apparatus, the developing means may include a toner carrying member which brings said toner particles into contact with said surface of said carrier carrying said electrostatic latent image through a nip of a predetermined width, and said toner carrying member may be operable to selectively stick said toner particles to said electrostatic latent image on said electrostatic latent image carrier and to collect residual toner on said electrostatic latent image carrier.

The developing means in this still another aspect of the invention may employ conditions such as a nip width, a thickness of a toner layer on the toner carrying member, type and amount of fluidization agent contained in the toner particles and a potential difference for the development of the electrostatic latent image and collection of the toner, which are the same as those in the image forming apparatus described before.

The charging means may be formed of a large number of brush hairs which slide on a surface of said electrostatic latent image carrier as said carrier moves and means for applying voltage to said brush hairs, so that said brush hairs may be operable to apply a predetermined voltage to said surface of said electrostatic latent image carrier and to clean said surface simultaneously.

Further, the invention also provides an image forming method wherein a step for forming an electrostatic latent image on an electrostatic latent image carrier, a developing step and a transferring step are applied, and subsequently, said electrostatic latent image forming step is applied again without applying a cleaning step to form a toner image on a recording medium.

This method may comprise the steps of:

forming said electrostatic latent image formed of an image part and a non-image part on said electrostatic latent image carrier;

causing a thin film layer formed of charged toner particles to be carried on a toner carrying member and bringing said thin film layer into contact with a surface of said electrostatic latent image carrier, said toner carrying member being adapted to receive a bias voltage operable to apply to the charged toner particles in said image part a coulomb force in a direction from said toner carrying member to said electrostatic latent image carrier and to apply to said particles in said non-image part a coulomb force in a direction opposite to said direction; and transferring said toner particles stuck to said image part to a recording medium.

In the method, said step for forming said electrostatic latent image may include a step of uniformly charging said surface of said electrostatic latent image carrier by a contact charger which is operable to apply a predetermined voltage to the image carrier by contacting said surface of said electrostatic latent image carrier, and a step for forming said image part and said non-image part by selectively removing charges from said uniformly charged surface of said electrostatic latent image carrier.

Further, the method may comprise the steps of:

charging said electrostatic latent image carrier by a charging brush which receives a predetermined voltage and contacts a surface of said electrostatic latent image carrier to uniformly charge said surface, whereby so that charging brush may be operable to clean said carrier while charging;

forming said electrostatic latent image formed of an image part and a non-image part by selectively removing a charge from the uniformly charged surface of said electrostatic latent image carrier;

developing said electrostatic latent image with charged particles on a toner carrying member; and transferring said toner particles stuck to said image part to a recording medium.

In this method, said toner carrying member is adapted to receive a bias voltage operable to apply to the charged toner particles in said image part a coulomb force in a direction from said toner carrying member to said electrostatic latent image carrier and to apply to said particles in said non-image part a coulomb force in a direction opposite to said direction.

These methods may also employ conditions such as a nip width, a thickness of a layer on the toner carrying member, type and amount of fluidization agent contained in the toner particles and a potential difference for the development of the electrostatic latent image and collection of the toner, which are same as those in the image forming apparatus described before.

Other objects and advantages of the present invention will become more apparent from the following detailed description, when taken into conjunction with the accompanying drawings which show, for the purpose of illustration only, embodiments in accordance with the present invention.

DETAILED DESCRIPTION OF THE PREFERRED EMBODIMENTS

First Embodiment

In this embodiment, an image formation is conducted in such a manner that an image exposure is applied to an electrostatic latent image carrier having a surface charged by the charger or charging device to form an electrostatic latent image, which is developed by a developing device into a visible image, and the visible image is transferred to a recording member. In this image formation, the above developing device is constructed to include a developer carrying member to which a developing bias voltage is applied. The developer carrying member has a surface, which carries one-component developer and is adapted to move while contacting the electrostatic latent image carrier, and is operable to remove residual developer on the electrostatic latent image carrier after the transferring.

The above term "the developer carrying member has a surface, which carries one-component developer and is adapted to move while contacting with the electrostatic latent image carrier" includes such meaning that, when the developer is not stuck to the developer carrying member, this carrying member is in complete contact with the electrostatic latent image carrier, and when the developer is stuck thereto, the carrying member comes in contact with the electrostatic latent image carrier through a layer of the stuck developer.

The developer carrying member may be of a sleeve type, in which it is fitted around a drive roller having an outer diameter slightly larger than an inner diameter of the sleeve, and is pressed onto the drive roller from a side opposite to the electrostatic latent image carrier, so that a slack formed at a side of the electrostatic latent image carrier is brought into contact with the latent image carrier and the sleeve is rotated by the drive roller, or may take another form such as one roll or belt, which is in contact with the electrostatic latent image carrier and is driven to rotate.

The contact described above between the developer carrying member and the electrostatic latent image carrier allows removal of the residual developer to the developer carrying member. A presumed reason is that the contact provides a scraping effect for the residual developer and that a proximity electrode effect increases an attractive force.

Figure 5:
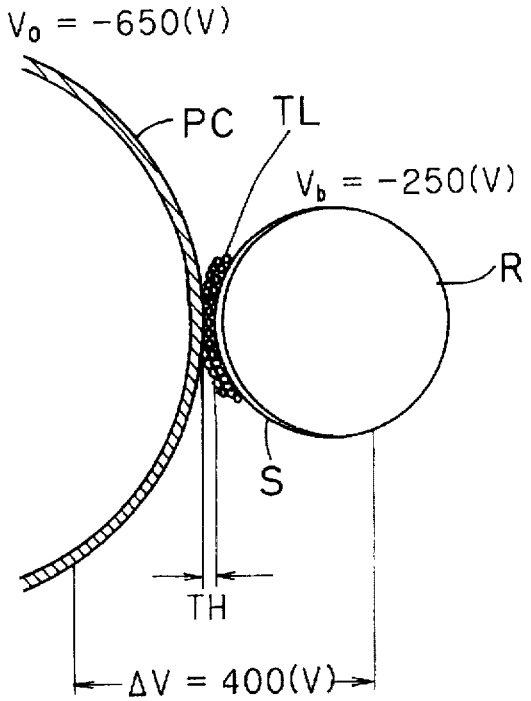
FIGS. 5 and 6 are views for illustrating difference in proximity electrode effect between a case in which a developing device using one-component developer is employed and a case in which a developing device using two-component developer is employed.
Figure 6:
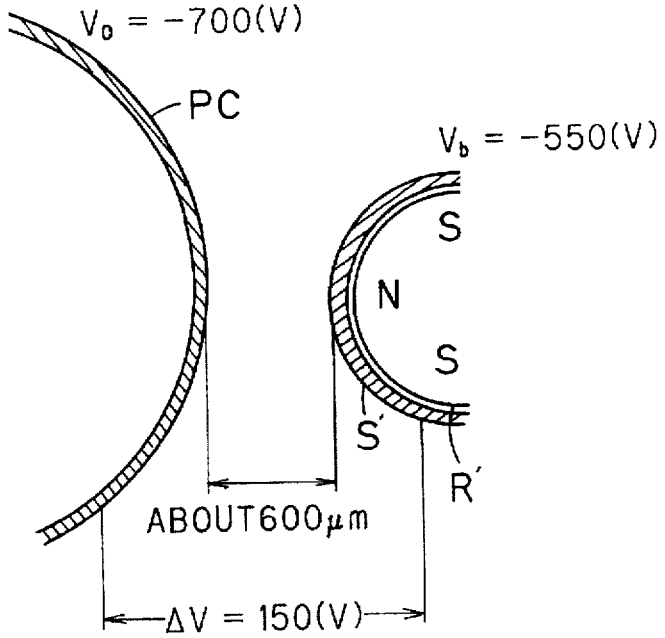

Now, consideration will be made with respect to FIG. 5, in which there is provided a one-component developing device (containing one-component developer formed of toner) having a developing sleeve S compressively fitted at one side thereof around a drive roller R. In standard setting conditions of this type, the sleeve S and a photosensitive drum PC contact together through a thin layer TL of developer having a thickness TH of about 30 μm. Further, a surface potential $V_0$ of the photosensitive member is −650 V, a bias voltage Vb applied to the sleeve is −250 V, and a potential difference ΔV therebetween is 400 V. Meanwhile, as shown in FIG. 6, there is also prepared a two-component developing device (containing two-component developer formed of toner and carrier) having a developing sleeve S' fitted around a magnet roller R'. In standard setting conditions of this type, a distance between the sleeve S' and the photosensitive drum PC is about 600 μm. Further, a surface potential $V_0$ of the drum is −700 V, a bias voltage Vb applied to the sleeve is −550 V, and a potential difference ΔV therebetween is 150 V. Electric field strengths obtained between these photosensitive drums and the sleeves are 13.3 V/μm in the one-component developing device and 0.25 V/μm in the two-component developing device, and thus the former has the field strength (proximity electrode effect) about 50 times as larger as that of the later, which indicates that the former has an excellent attractive force for the residual developer.

A contact width (nip width) between the developer carrying member and the electrostatic latent image carrier is preferably about 1 mm or more, more preferably about 2 mm or more. However, it should remain in a range in which both the latent image carrier and the developing member are not damaged and smooth actions thereof are not prevented.

In order to increase the nip width, the electrostatic latent image carrier may be of a belt type.

Then, a specific example will be described with respect to a printer according to the invention in FIG. 1.

This printer is provided at its central portion with a photosensitive drum 1, around which there are provided a brush charging device or charger 200, an exposing device 3, a developing device 4, a transfer charger 50 and a separator charger 60 which are circumferentially distributed or aligned.

The brush charger 200 contacts a surface of the photosensitive drum 1 to conduct uniform charging of the surface at −600 V. The brush charger 200 is formed of electrically conductive brush hairs 201 and a power supply 202 which applies a negative voltage to these brush hairs 201. The brush hairs 201 may be formed of polymer fiber such as rayon in which electrically conductive particles such carbon black are distributed.

The exposing device 3 utilizes a well-known semiconductor laser, and light-adjustment is performed in such a manner that an image part of the surface, which has been charged to −600 V, of the photosensitive drum 1 is reduced to about −50 V.

The developing device 4 is the one-component developing device. The device 4 has a casing 41 supporting a drive roller 42 rotating in a clockwise direction in the Figure, a flexible developing sleeve 43 having an inner diameter slightly larger than an outer diameter of the roller 42 and fitted therearound and a pressure belt member 44 which biases opposite ends of the sleeve 43 from an inner side of the casing 41 to press it onto the drive roller 42 so that a slack 430 contacting the photosensitive drums is formed at an opposite side. Further, the developing sleeve 43 is in contact with a metal restriction blade 45 located in the casing 41.

The casing 41 accommodates one-component developer, i.e., toner T, which is agitated by an agitator 46 driven to rotate in a counterclockwise direction in the Figure and is supplied to a toner supplying roller 47. The roller 47 is driven to rotate in the clockwise direction in the Figure to move the toner T toward the developing sleeve 43. The developing sleeve 43 rotates in a same direction as the rotating drive roller 42 owing to a friction therebetween, while the controlling blade 45 frictionally charges the toner T and sticks it to the developing sleeve 43 at a constant rate. The developing sleeve 43 rotates to supply continuously the toner T to a portion of the photosensitive drum 1 contacting it.

A developing bias voltage −250 V is applied from a power supply 400 to the developing sleeve 43 to enable sticking of the toner T to a latent image on the photosensitive drum 1.

The photosensitive drum 1, the toner T to be used and the developing sleeve 43 have following specifications.

Photosensitive drum: An aluminum base (drum member) is coated with a charge generation layer CGL of about 0.1 μm formed of phthalocyanine and binder resin, and a charge transfer layer CTL of about 18 μm formed of hydrazone derivative and binder resin, which are sequentially formed on the drum by coating in the dipping method and drying.

Toner: Negative chargeable one-component non-magnetic toner which has a following composition and is fabricated in a following method.

Composition:

Bisphenol A type polyester resin, 100 parts by weight, Carbon black (produced by Mitsubishi chemical Industries Ltd., MA#8), 5 parts by weight, Dyestuff (Bontron S-34, produced by Orient Kagaku Kogyo K.K.), 3 parts by weight, Wax, Viscol TS-200 (produced by Sanyo chemical industries Ltd.), 2.5 parts by weight.

The above components are kneaded, ground and classified to produce toner particles having a volume mean particle diameter of 10 μm and a distribution of 80 wt % in a range from 7 to 13 μm.

Further, fine particles of silica (Taranox 500 manufactured by Taruko Co.) are added by 0.75 parts by weight to the above toner particles for surface treatment.

Developing sleeve: A round bar of stainless steel having a diameter of 25 mm is immersed in nickel electrolyte, and a cylindrical nickel sleeve having a film thickness of about 35 μm is formed thereon by an electroforming method.

The nip width thereof with respect to the photosensitive drum in the developing process may be in a range nearly from 1 mm to 1.5 mm.

The blade 45 can stick the toner T to the developing sleeve 43 in such conditions that the sticking amount is 0.6 mg/cm$^2$, a thickness of the toner layer is about 0.03 mm and the charged amount is −20 μc/g.

According to the printer described above, the surface of the rotated photosensitive drum 1 is charged by the brush charger 200 to have a uniform surface potential of −650 V, and subsequently, the exposing device 3 performs the image exposure to form the latent image. The surface potential of the exposed portion is reduced to a value of about −50 V. The electrostatic latent image thus formed is developed by the developing device 4 with the developing bias voltage of −250 V to form a toner image. In this development, the toner T on the developing sleeve 43 sticks to the latent image owing to the potential difference ΔV of 200 V.

The toner image thus formed is transferred by the transfer charger 50 onto a paper sheet 7 which is supplied from unillustrated paper sheet supply mechanism. The paper sheet after the transference is separated from the photosensitive drum 1 by the separator charger 60 and moves to an unillustrated fixing device, in which the toner image is fixed prior to discharging.

However, the toner on the photosensitive drum 1 is not entirely transferred onto the sheet 7 by the transfer charger 50, and 10–20% of the toner remains as the residual toner on the photosensitive drum 1. This residual toner passes a charging step effected by the charger 200 and, if necessary, a step for the image exposure by the exposing device 3, and returns to the developing device 4. Then, the residual toner in the non-image part is collected to the developing sleeve 43.

It should be noted that if the charging and exposure are conducted with the residual toner remaining on the photosensitive drum 1, such a problem may be caused that a portion bearing the residual toner is not charged and/or exposed. However, it has been found from a final fixed image on the sheet 7 that the transference efficiency of about 60% or more in the transfer charger 50 can prevent the above problem. The reason for this can be presumed as follows. Even if a small amount of toner remains on the drum 1, the charger 200 uniformly charges the surface of the drum 1 and the laser beam advances up to a lower portion of the residual toner.

Now, description will be made with respect to a mechanism for collecting and removing the residual toner by the developing device 4.

As described above, even if there is a portion bearing the residual toner, the surface of the photosensitive drum 1 has a substantially uniform potential of about −600 V charged by the charger 200. Meanwhile, the developing bias voltage of −250 V is applied to the developing sleeve 43.

Therefore, it can be presumed that the residual toner T on the non-image part on the drum 1 is biased to move toward the developing sleeve 43 by the potential difference of about 350 V, and simultaneously, the developing sleeve 43 and the toner layer thereon apply the scraping effect for the residual toner, so that the residual toner on the non-image part is collected and removed toward the developing sleeve 43.

Figure 2:
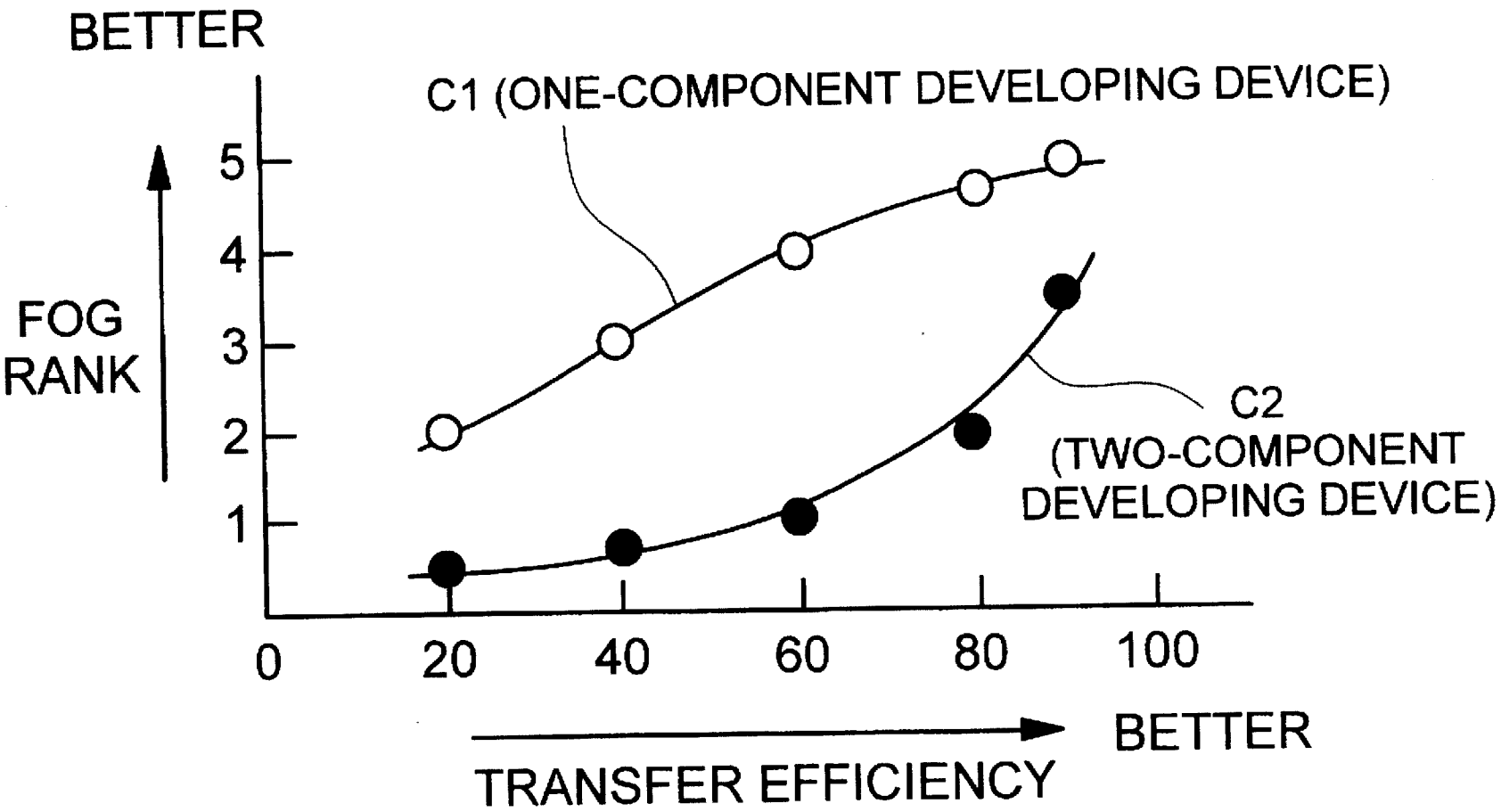
FIG. 2 is a graph illustrating variation of fog ranks with respect to various transfer efficiencies in printers shown in FIGS. 1 and 4.

Fog ranks in the image fixed recording sheets are also determined with respect to various conditions of the transfer charger and the various transfer efficiencies, which results in a curve C1 shown in FIG. 2.

Figure 4:
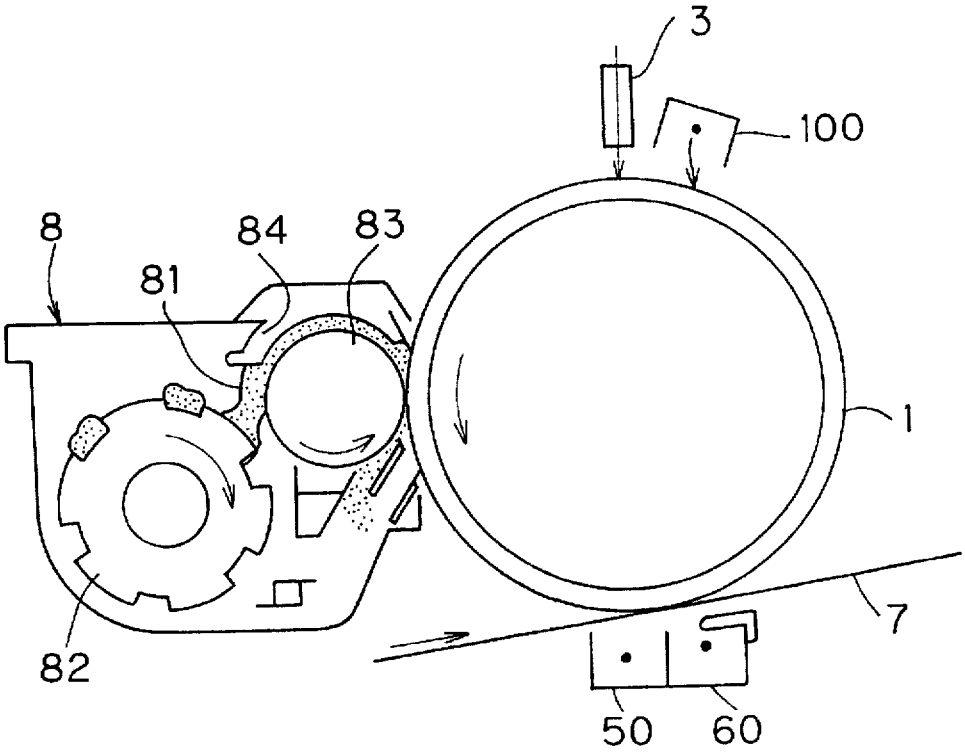
FIG. 4 is a schematic cross section of a printer provided with a developing device using two-component developer.

Further, the fog ranks in the image fixed recording sheet are also determined in the printer employing the two-component developing method shown in FIG. 4 with respect to various conditions of the transfer charger 50 and the various transfer efficiencies, which results in a curve C2 shown in FIG. 2.

Structures and operations of the printer shown in FIG. 4 will be briefly described below.

The photosensitive drum 1 is charged to about −700 V by the corona charger 100 and is exposed by the exposing device 3 to reduce the potential of the image part to about −100 V. The developing device 80 accommodates two-component developer 81, which is metered to have a carrier to toner weight ratio of about 100 to 6. The developer 81 is mixed and agitated by a bucket 82, and is moved on a developing sleeve 83 toward the photosensitive drum 1 by a rotating magnet roller (not shown) disposed in the developing sleeve 83, during which it is adjusted to form a layer having a uniform thickness by a controlling blade 84. In this operation, the charged amount of the toner is adjusted to be about −15 μc/g. The bias voltage of −550 V is applied to the developing sleeve 83. Further, a developing gap Ds between the photosensitive drum 1 and the developing sleeve 83 is determined to be about 0.6 mm for obtaining the optimum image.

Figure 1:
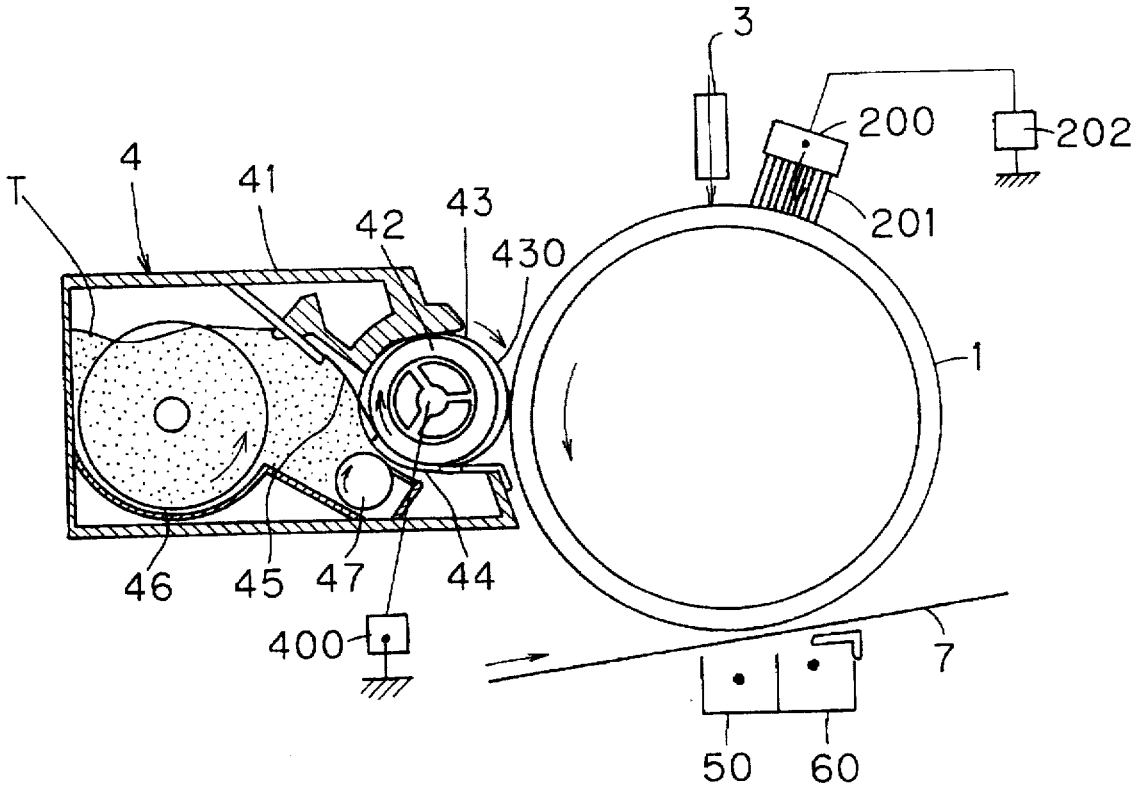
FIG. 1 is a schematic cross section of a printer according to an embodiment of the invention.

As shown in FIG. 2, the curve C1 for the one-component developing device shown in FIG. 1 and the curve C2 for the two-component developing device shown in FIG. 4 have a difference which is presumed to be produced by the following reason. The curve C2 by the two-component developing device has the developing gap Ds of about 0.6 mm (generally 0.4–0.8 mm is required), while, with respect to the curve C1 by the one-component developing device, the toner layer on the developing sleeve has a small thickness of about 0.03 mm, so that the field strength between the photosensitive drum and the developing sleeve is remarkably changed at the non-image part. In other words, in the image forming apparatus employing the two-component developing device, it is difficult to collect and remove the toner by the developing device. Meanwhile, in the one-component developing device having the developing sleeve which carries the one-component developer and is in contact with the photosensitive drum 1 during movement, it is possible to collect and remove the residual toner. This achieves a remarkable advantage when using the toner having a small particle diameter, i.e., a volume mean particle diameter of 3–15 μm, of which actual use has been desired for improving the image quality in recent years.

Figure 3:
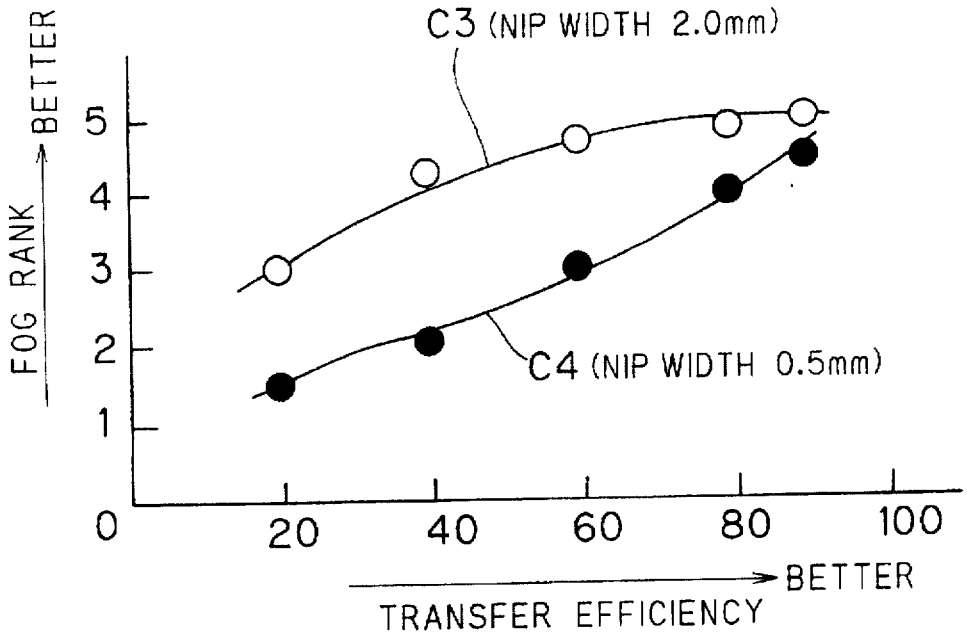
FIGS. 3 is a graph illustrating variation of fog ranks with respect to various transfer efficiencies and to various contact nip widths between a developing sleeve and a photosensitive drum in a printer shown in FIG. 1.

The fog ranks in the printer shown in FIG. 1 have also been determined with respect to various contact nip widths between the photosensitive drum 1 and the nickel electroforming sleeve 43 of the developing device 4, of which result is shown in FIG. 3. In FIG. 3, a curve C3 indicates the nip width of 2.0 mm and the curve C4 indicates the nip width of 0.5 mm.

As can be seen from FIG. 3, if the fog rank having a value of 3 or more is rated to be acceptable, the contact nip width between the developing sleeve and the photosensitive drum is preferably about 1 mm or more, and more preferably about 1.5 mm or more.

In the printer described above, a conventional cleaning device is eliminated, which reduces the whole sizes and the cost. Further, the residual toner on the photosensitive drum 1 can be electrically attracted and removed to the developing sleeve 43 of the developing device 4, so that the developer can be facilely removed even if it is formed of the toner having a small diameter. Since the residual toner on the drum 1 is collected to the developing device 4, the toner can be saved. Since a cleaning member and others do not contact the photosensitive drum 1, the durability of the drum 1 can be increased.

The one-component developer which is preferably used in the invention has the volume mean particle diameter of 3–15 μm. If it is smaller than 3 μm, the simultaneous cleaning in the developing section cannot be sufficiently performed due to an excessively large sticking force to the surface of the photosensitive drum 1. Meanwhile, if it is larger than 15 μm, inconvenience may be caused with respect to an image reproducibility.

Further, in the invention, it is important that the developing sleeve 43 carries on its surface the one-component developer in a form of a thin layer which contacts the surface of the photosensitive drum 1 through an appropriate nip width of 1 mm or more and preferably 1.5 mm or more to perform the developing and cleaning, as described before. In this case, since the thin layer contacts both the developing sleeve 43 and the surface of the photosensitive drum 1, the residual developer is collected by the proximity electrode effect described above. Further, relative movement of the developing sleeve 43 and the surface of the photosensitive drum 1 with respect to the thin layer causes a shearing force which acts to cause sliding on the surface of the photosensitive drum 1 in the thin layer, whereby the residual toner on the surface of the photosensitive drum 1 is scraped off. Therefore, the proximity effect by the electric field described above can be expected only by setting the thickness of the thin layer smaller than a given value. Further, with respect to the scraping effect described above, if the thickness of the thin layer is increased to some extent, the developer near the surface of developing sleeve 43 moves at a speed same as that of the sleeve 43, and the developer near the surface of the photosensitive drum 1 also moves at a speed same as that of the photosensitive drum 1, so that the shearing force in the thin layer can hardly contribute to the scraping of the residual toner. In view of the above two points, the thin layer is preferable to have the thickness smaller than an appropriate value. Further, a lower limit of the thickness of the thin layer is a value below which the used developer cannot form the uniform layer on the sleeve 43.

Therefore, the thin layer of the developer has the thickness in a range of nearly 3–100 μm, preferably 15–60 μm and more preferably 20–40 μm.

In the embodiment described above, an absolute value of the potential difference for sticking the toner is $|250-50|=200$ V, and an absolute value of the potential difference for collecting the toner is $|650-250|=400$ V. However, a sufficient image density can be obtained if the absolute value of the potential difference for sticking the toner is in a range from $|100|$V to $|400|$V, and the absolute value of the potential difference for collecting the toner is one to four times as large as it.

In the invention, the developer contacts both the developing sleeve 43 and the surface of the photosensitive drum 1 while the development and cleaning are being performed. Therefore, if the developer does not have stable frictional charging characteristics, the developer is reversely charged, which causes such a disadvantage that the developer to be collected from the photosensitive drum 1 cannot be collected in practice. In order to overcome this disadvantage, it is preferable to add various kinds of fluidization agent to the one-component developer to be used in the invention. The fluidization agent may be preferably particles of metallic oxide such as silica, alumina or titanium oxide, or resin particles such as vinylidene fluoride, fluororesin or polyethylene. It is preferable to add the fluidization agent to the one-component developer at about 0.1–5 wt % and preferably about 0.1–3 wt %.

Second Embodiment

This embodiment includes a combination of the charging section provided with the charger brush and the developing section capable of removing the residual developer.

Specifically, this image forming apparatus employs a charging and developing device, in which the surface of the electrostatic latent image carrier in the image forming apparatus is charged, and the electrostatic latent image is formed by the image exposure applied to the image carrier after charging, and is developed to form the visible image. The above charging brush in the charging section contacts the image carrier. The developing section can perform the developing and also can collect the residual developer remaining on the electrostatic latent image carrier after the transfer of the visible image to the recording member.

Further, the charging and developing device may have replaceable unit or modular structures. Specifically, it may be formed by unit or cartridge structures which include the charging brush associated to the developing section and is removably attached to the image forming apparatus as a whole.

In the image forming apparatus employing this charging and developing device, the charging brush can charge the surface of the electrostatic latent image carrier to a desired potential, the developing section can develop the electrostatic latent image on the image carrier into the visible image, and, after the transfer, the developer of the non-image region remaining on the image carrier can be removed. Further, when the residual developer passes the charging brush, the pattern thereof is disturbed by collision thereof with the brush hairs, whereby the appropriate charging and exposure are allowed without being prevented by the residual developer.

Further, paper powder or dust is caught by the charging brush, so that the amount of the paper powder mixing in the developing section is reduced.

If this charging and developing device has the unit structures, the whole unit can be removed from the image forming apparatus for replacement with a new unit after usage for a predetermined period, which is determined in view of factors such as sticking of the paper powder and others to the charging brush and the amount of the used developer in the developing section.

A specific example will be described with reference to a printer P according to the invention shown in FIG. 7 and a charging and developing unit or cartridge A shown in FIG. 8 which is removably attached to the printer.

Figure 7:
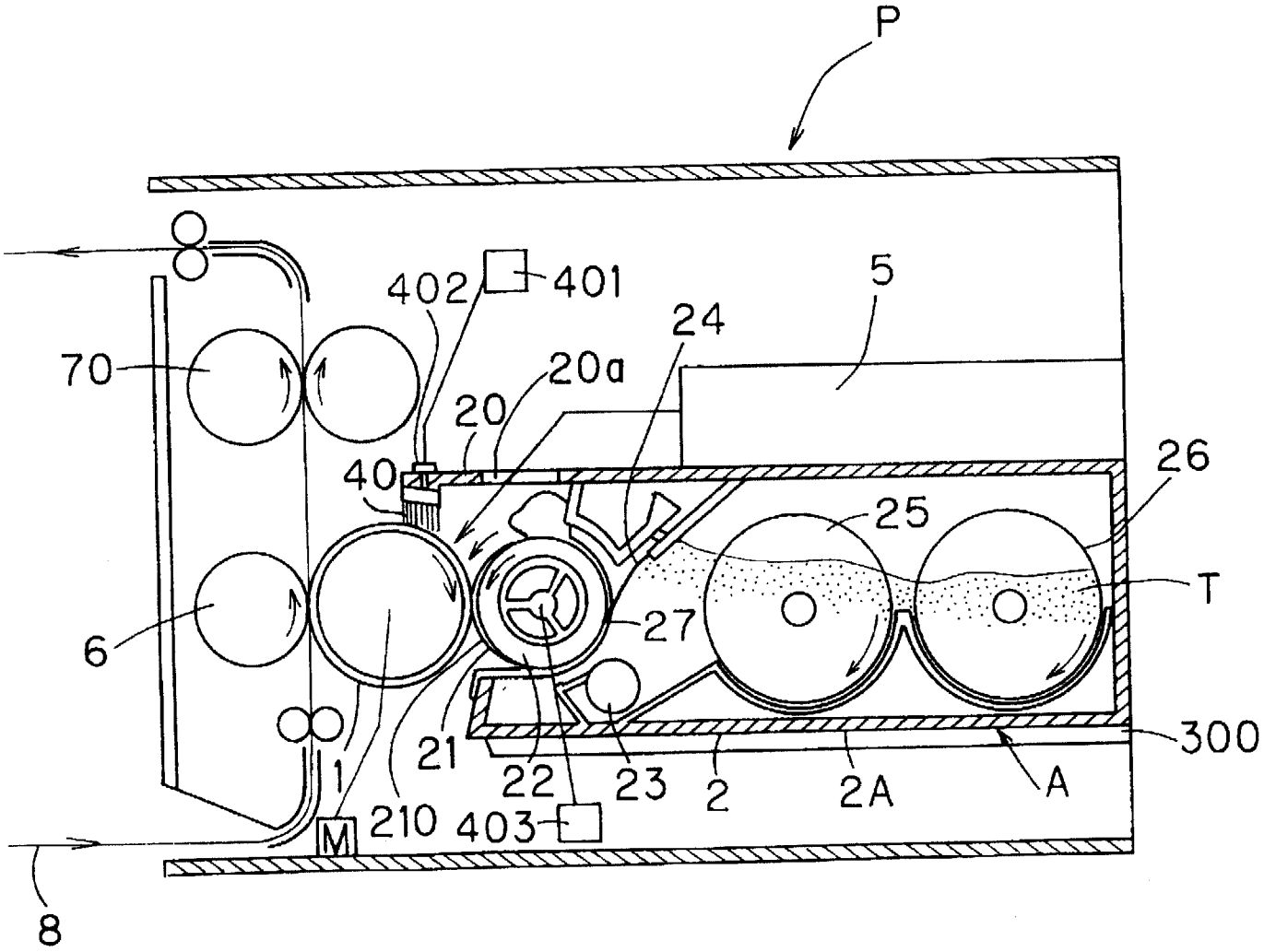
FIG. 7 is a schematic cross section of another printer according to the invention.
Figure 8:
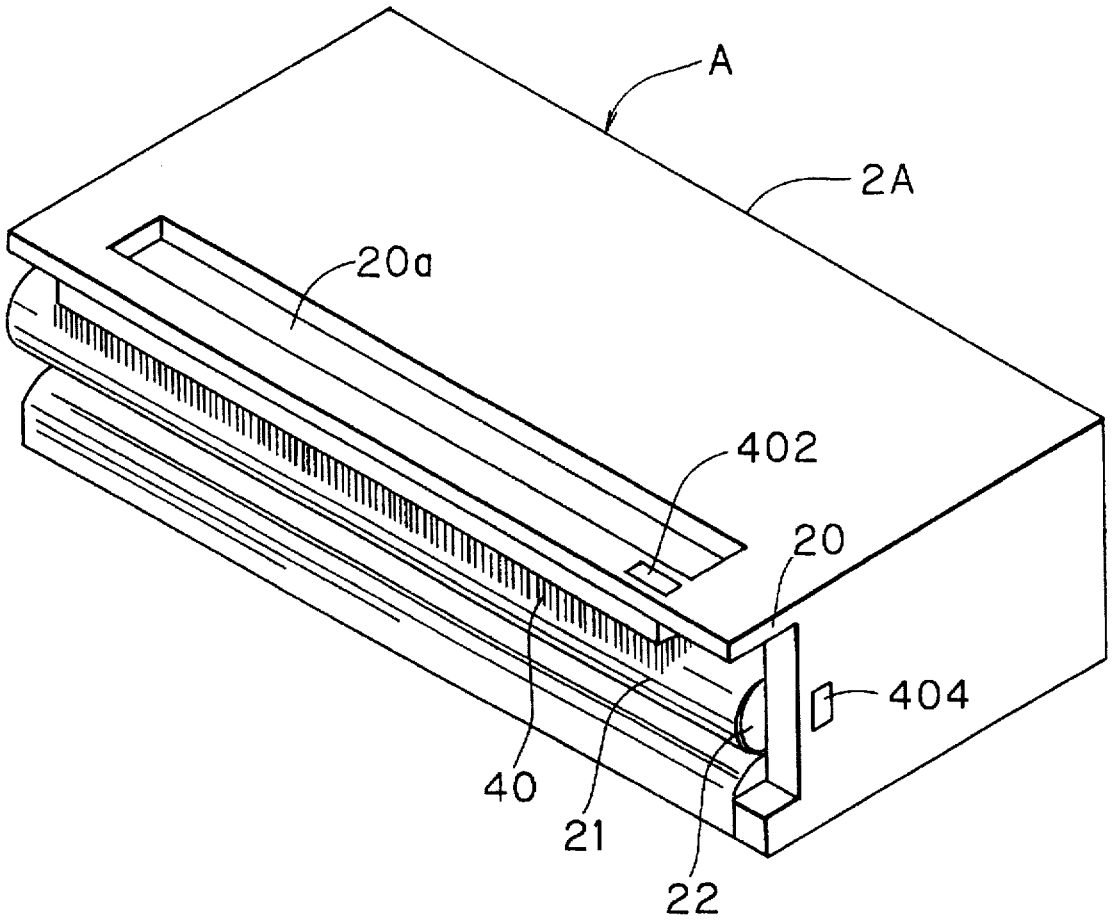
FIG. 8 is a schematic perspective view of a charging and developing section in a printer in FIG. 7.

This printer P comprises a photosensitive drum 1 which is driven by a motor M to rotate in a clockwise direction with respect to the sleeve 21 as shown in FIG. 7, and is provided with the developing section 2, charging brush 40, exposing device 5 and transfer roller 6, which are associated to the drum 1, as well as the fixing device 70 disposed above the transfer roller 6.

The charging brush 40 is carried by a projected arm 20 formed integrally with the developing section 2 to be in contact with the photosensitive drum 1. These developing section 2 and the charging brush 40 forms the charging and developing unit A which is removably attached to a printer body by means of guide rails 300 provided in the printer body.

The developing section 2 has a casing 2A supporting a drive roller 22 rotating in a counterclockwise direction with respect to the drum 1 as shown in FIG. 7, a flexible developing sleeve 21 having an inner diameter slightly larger than an outer diameter of the roller 22 and fitted therearound and a pressure belt member 27 which biases opposite ends of the sleeve 21 from an inner side of the casing 2A to press it onto the drive roller 22 so that a slack 210 contacting the photosensitive drum 1 is formed at an opposite side. The contact nip width is about 1 mm or more, and preferably 1.5 mm or more. Further, the developing sleeve 21 is in contact with a controlling metal blade 24 located in the casing 2A.

The developing sleeve 21 is a sleeve of nickel manufactured in an electroforming method, and has a thickness of about 35 μm. The blade 24 is made from stainless steel and has a thickness of 0.1 μm and a free length of 18 mm as well as a pressing force of 3 g/mm to the developing sleeve.

The unit casing 2A contains the toner T which is non-magnetic one-component developer same as that in the embodiment 1. The toner is agitated by agitators 25 and 26 driven to rotate in a clockwise direction in the Figure, and is moved onto the toner supplying roller 23, which rotates in a counterclockwise direction in the Figure to supply the toner to the sleeve 21.

The developing sleeve 21 rotates in a same direction as the rotating drive roller 22 owing to a friction therebetween, while the blade 24 frictionally charges the toner T and sticks it to the developing sleeve at a constant supply rate. In this embodiment, the sticking amount of the toner T is about 0.6 $mg/cm^2$, and the charged amount is about 20 μc/g. The developing sleeve 21 rotates to supply continuously the toner T to a portion of the photosensitive drum 1 contacting it.

A voltage of −1 KV is applied to the charging brush 40 from a power supply 401 through a terminal 402 when the charging and developing unit A is attached to the printer body, whereby the surface of the photosensitive drum 1 is charged to about −600 V. Meanwhile, the developing bias voltage of about −250 V is applied to the developing sleeve 21 from the power supply 403 through a terminal 404 (see FIG. 8) when the charging and developing unit A is attached to the printer body. This bias voltage enables sticking of the toner T to the electrostatic latent image on the photosensitive drum 1.

The exposing device 5 utilizes a well-known semiconductor laser, and light-adjustment is performed in such a manner that an image part of the surface of the photosensitive drum 1, which has been charged to −600 V, is reduced to about −50 V by the laser irradiation.

The rays of light from the exposure device 5 are irradiated to the surface of the photosensitive drum 1 through an aperture **20*a* provided in the arm 20 carrying the charging brush 40**.

According to the printer P described above, the surface of the photosensitive drum 1 rotated in the clockwise direction in the Figure is charged by the charging brush 40 to have a uniform surface potential of −600 V, and subsequently, the exposing device 5 performs the image exposure to form the latent image. The surface potential of the exposed portion is reduced to a value of about −50 V. The electrostatic latent image thus formed is developed by the developing section 2 with the developing bias voltage of −250 V to form the toner image. In this development, the toner T on the developing sleeve 21 sticks to the latent image owing to the potential difference ΔV of about 200 V.

The toner image thus formed is transferred by the transfer roller 6 onto a paper sheet 8 which is supplied from unillustrated paper supply means and the paper sheet is discharged after the toner image is fixed by the fixing device 70.

However, the tones on the photosensitive drum 1 is not entirely transferred onto the sheet 8 by the transfer roller 6, and 10–20% of the toner remains as the residual toner on the photosensitive drum 1. This residual toner T in the non-image part passes the charging step effected by the charging brush 40 and, if necessary, a step for the image exposure by the exposing device 5, and returns to the developing section 2. Then, the residual toner T is collected to the developing sleeve 21. In this operation, the potential gap between the surface potential of the photosensitive drum and the sleeve potential in the developing region causes the toner T to move toward the sleeve by the difference of about 350 V with respect to the non-image part and to move toward the photosensitive drum 1 by the difference of about 200 V with respect to the image part, and in practice, unnecessary residual toner is cleaned off.

In the above steps, the charging brush 40 allows passage of the residual toner T which has stuck to the photosensitive drum 1, but catches the paper powder to an extent corresponding to the density of the brush hairs, so that mixing of the paper powder in the developing section 2 is prevented. When the residual toner T passes the charging brush 40, it collides with individual brush hairs so that the positions of the toner particles are disturbed. Thereby, the charging by the charging brush 40 is uniformly performed throughout the surface of the photosensitive drum. Further, with respect to the image exposure after the charging, since the residual toner pattern has been disturbed, the appropriate image exposure can be performed.

The charging brush 40 has extremely simple structures and does not require an expensive high voltage power supply, which is required in a corona charger, so that the whole unit A can be manufactured to have simple structures at a low cost. Further, the charging brush 40 can advantageously prevent the generation of ozone, which may be caused in the corona charger.

Although the various advantages described above can be achieved by structures other than the unit or modular structures of the charging brush 40 and the developing section 2, the unit structures employed in this embodiment can provide an advantage with respect to maintenance, which will be described below.

Figure 9:
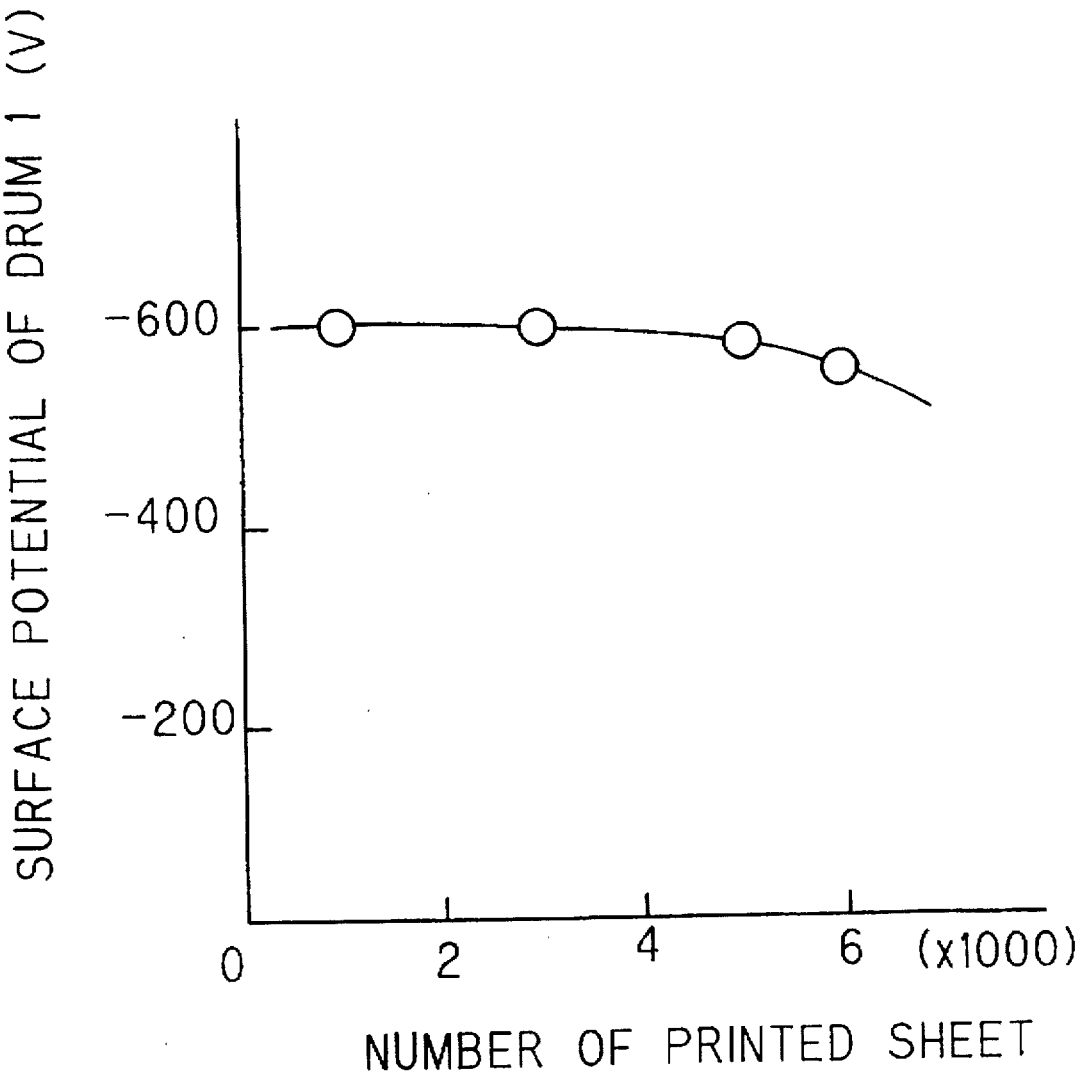
FIG. 9 is a graph for illustrating reduction of a surface potential of a photosensitive member caused by a charging brush in accordance with increase of a number of printed sheets.

As the number of the printed sheets increases in the printer described above, the charging capacity of the brush reduces, because the amount of the paper powder caught by the charging brush 40 in the charging and developing unit A gradually increases and the fine toner, which is not transferred or insufficiently charged, sticks to the charging brush. FIG. 9 illustrates this condition. This reduction of the charging capacity may change in accordance with the hair density, width, resistance and contact pressure of the brush, length of the brush hair, type of the toner, quality of the paper sheet and others. In this example, as can be seen from FIG. 9, the surface potential of the photosensitive drum 1 apparently starts to decrease at the printed sheet number of about 5000, and thus the number of 5000–6000 forms a limit with respect to the durability. Therefore, in this example, the amount of the toner filled in the developing section 2 is determined to allow printing of about 3000 sheets of test charts bearing the images of a mean BW ratio (black/white ratio) of 5%, and thus the unit will be replaced with a new unit after the printing of the 3000 sheets. This allows extremely easy and collective maintenance relating to sticking of the paper powder and others in the charging brush 40, deterioration of the toner in the developing section 2, mixture of the paper powder and supplement of the toner, and thus stable images can be obtained for a long term as a whole.

Third Embodiment

This embodiment is characterized in that an inner base member of the image carrier is light transmissible, and the exposure section for the image exposure is opposed to the light transmissible base member with respect to a developing section.

In this embodiment, the image carrier is charged from a side of its outer surface by the charging device, and the image exposure is performed without being affected by the residual developer from a side of the inner light transmissible base member to form the electrostatic latent image, which is developed by the developing device into a visible image. This visible image is transferred to the recording member for fixing.

After the transference, the developer remaining on the image carrier is processed in such a manner that recharging of the image carrier is performed by the charging device from the above of the developer, and the developer in the non-image part is collected to the developing device.

Figure 10:
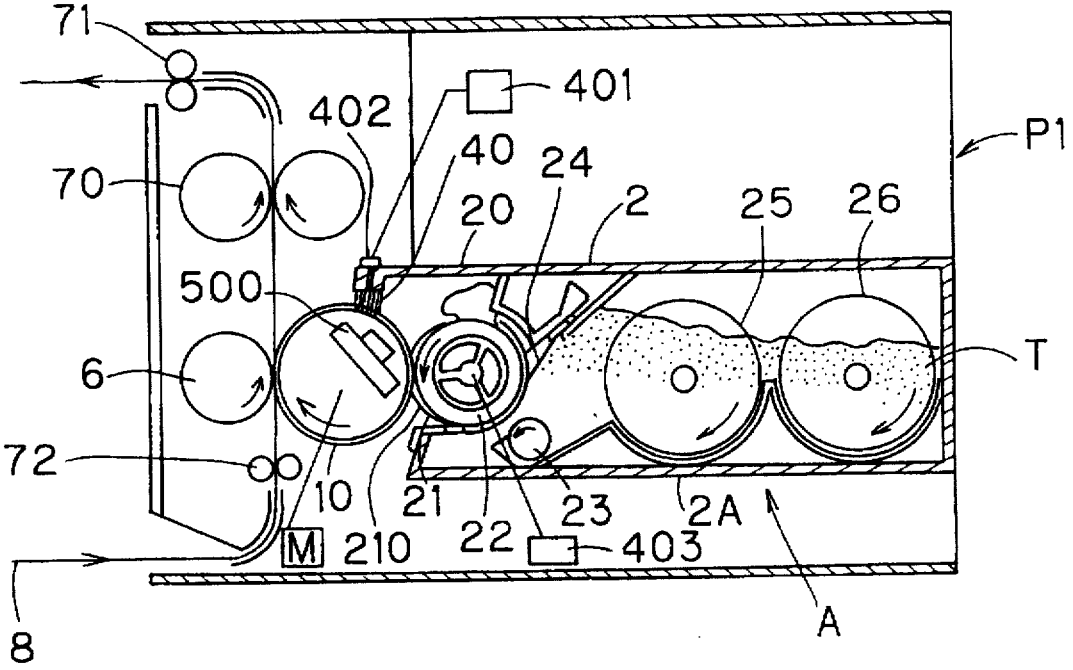
FIG. 10 is a schematic cross section of still another printer according to the invention.
Figure 11:
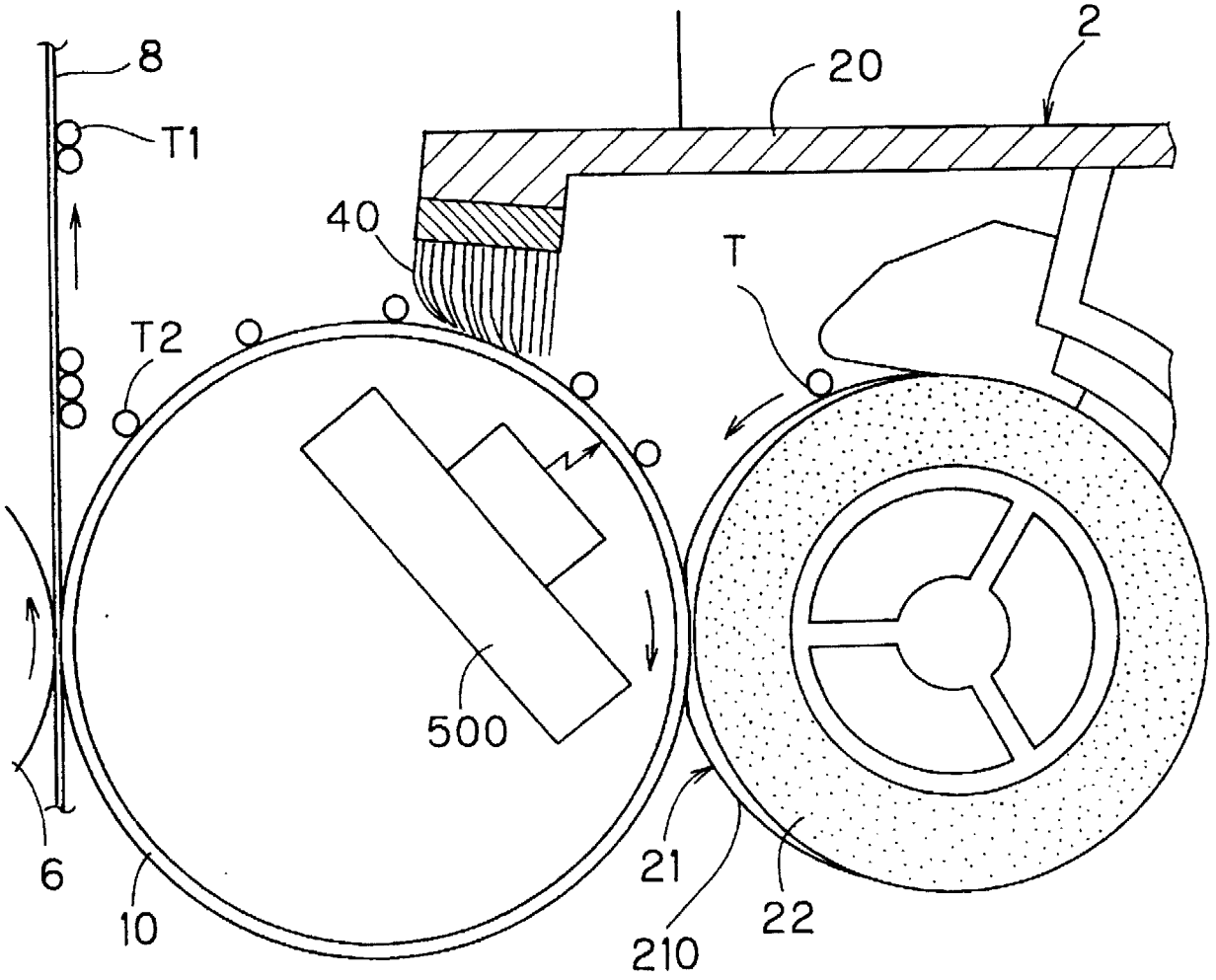
FIG. 11 is a partially enlarged view of a printer in FIG. 10.

Specific example will be described with reference to a printer according to the invention in FIG. 10. FIG. 10 illustrates schematic structures of the printer P1, FIG. 11 illustrates an enlarged portion of the printer and FIG. 12 illustrates structures of the photosensitive drum of the printer.

This printer P1 comprises the photosensitive drum 10 which is driven in a clockwise direction with respect to the rotating direction of a sleeve 21 as shown in FIG. 10, and is provided with the developing section 2, charging brush 40, exposing device 500 and transfer roller 6, which are associated to the drum 10, as well as the fixing device 70 disposed above the transfer roller 6.

Figure 12:
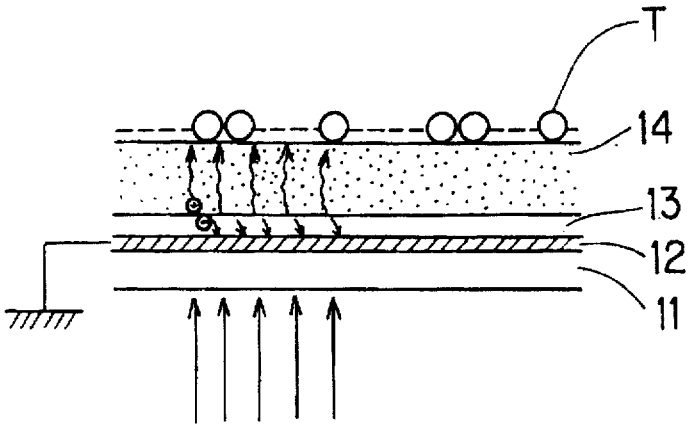
FIG. 12 is a view for illustrating structures of a photosensitive drum in a printer in FIG. 10.

As shown in FIG. 12, the photosensitive drum 10 includes a transparent glass base member 11 over which a transparent and electrically conductive layer 12 such as a thin film which is formed by aluminum vapor deposition or ITO thin film, as well as a CGL 13 (charge generation layer of about 0.2 μm or less) and a CTL 14 (charge transmitting laye of about 20 μm or less). The base member 11 may be formed of transparent resin such as polycarbonate.

The charging brush 40 is carried by the projected arm 20 formed integrally with the developing section 2 to be in contact with the photosensitive drum 10. These developing section 2 and the charging brush 40 forms the charging and developing unit A which is removably attached to a printer body.

The developing section 2 has the casing 2A supporting the drive roller 22 rotating in the counterclockwise direction in the Figure, the flexible developing sleeve 21 having an inner diameter slightly larger than an outer diameter of the roller 22 and fitted therearound and the pressure belt member 27 which biases opposite ends of the sleeve 21 from an inner side of the casing 2A to press it onto the drive roller 22 so that the slack 210 contacting the photosensitive drum 1 is formed at an opposite side. The contact nip width is about 1 mm or more, and preferably 1.5 mm or more. Further, the developing sleeve 21 is in contact with the metal blade 24 located in the casing 2A.

The developing sleeve 21 is a sleeve of nickel manufactured in an electric plate method, and has a thickness of about 35 μm. The blade 24 is made from stainless steel and has a thickness of 0.1 mm and a free length of 18 mm as well as a pressing force of 3 g/mm to the developing sleeve.

The unit casing 2A contains the developer which is the non-magnetic one-component dielectric toner T. The toner is agitated by agitators 25 and 26 driven to rotate in a clockwise direction as shown in FIG. 10, and is moved onto the toner supplying roller 23, which rotates in a counterclockwise direction as shown in FIG. 10 with respect to the sleeve 21 to supply the toner to the sleeve 21.

The developing sleeve 21 rotates in a same direction as the rotating drive roller 22 owing to a friction therebetween, while the blade 24 frictionally charges the toner T and sticks it to the developing sleeve at a constant supply rate. In this embodiment, the sticking amount of the toner T is about 0.6 $mg/cm^2$, and the charged amount is about −20 μc/g. The developing sleeve 21 rotates to supply continuously the toner T to a portion of the photosensitive drum 1 contacting it.

A voltage of −1 KV is applied to the charging brush 40 from a power supply (400) in the printer body through a terminal 402, whereby the surface of the photosensitive drum 10 is charged to about −600 V. Meanwhile, the developing bias voltage of about −250 V is applied to the developing sleeve 21 from the power supply (403) in the printer body through a terminal (not shown). This bias voltage enables sticking of the toner T to the latent image on the photosensitive drum 10.

The exposing device 500 utilizes a well-known semiconductor laser generating device, and is disposed opposite to the glass base member 11 with respect to the developing section 2 in the photosensitive drum 10. The laser beam can substantially pass the glass base member 11. In the device 500, the light-adjustment is performed in such a manner that the image part of the surface of the photosensitive drum 10, which has been charged to −600 V, is reduced to about −50 V by the laser irradiation from the surface of the glass member.

In FIG. 10, numerals 71 and 72 indicate sheet guide roller pairs, respectively.

According to the printer P1 described above, the surface of the photosensitive drum 10 rotated in the clockwise direction in the Figure is charged by the charging brush 4 to have a uniform surface potential of −600 V, and subsequently, the exposing device 500 performs the image exposure from the side of the glass base member 11 to form the latent image. The surface potential of the exposed portion is reduced to a value of about −50 V. The electrostatic latent image thus formed is developed by the developing section 2 with the developing bias voltage of −250 V to form the toner image. In this development, the toner T on the developing sleeve 21 sticks to the latent image owing to the potential difference ΔV of about 200 V.

The toner image T1 (see FIG. 11) thus formed is transferred by the transfer roller 6 onto the paper sheet 8 which is supplied from unillustrated paper supply means and the paper sheet is discharged after the toner image is fixed by the fixing device 700.

However, the toner on the photosensitive drum 10 is not entirely transferred onto the sheet 8 by the transfer roller 6, and 10–20% of the toner remains as the residual toner on the photosensitive drum 10. This residual toner T2 (see FIG. 11) passes the charging step effected by the charging brush 40 and, if necessary, a step for the image exposure by the exposing device 500, and returns to the developing section 2. Then, the residual toner T2 in the non-image region is collected to the developing sleeve 21. In this operation, the potential gap between the surface potential of the photosensitive drum and the sleeve potential in the developing region causes the toner to move toward the sleeve 21 by the difference of about 350 V with respect to the non-image part and to move toward the photosensitive drum 10 by the difference of about 200 V with respect to the image part, and in practice, unnecessary residual toner is cleaned off.

In the above steps, the charging brush 40 allows passage of the residual toner T2 which has stuck to the photosensitive drum 10, but catches the paper powder to an extent corresponding to the density of the brush hairs and others, so that mixing of the paper powder in the developing section 2 is prevented. When the residual toner T2 passes the charging brush 40, it collides with individual brush hairs so that the positions of the toner particles are disturbed. Thereby, the charging by the charging brush 40 is uniformly performed throughout the surface of the photosensitive drum.

When the image exposure is performed after the charging, it is performed from the side of the glass base member 11 of the photosensitive drum 10 at which the residual toner T2 does not exist, so that the exposure can be appropriately performed without influence by the residual toner.

Figure 13:
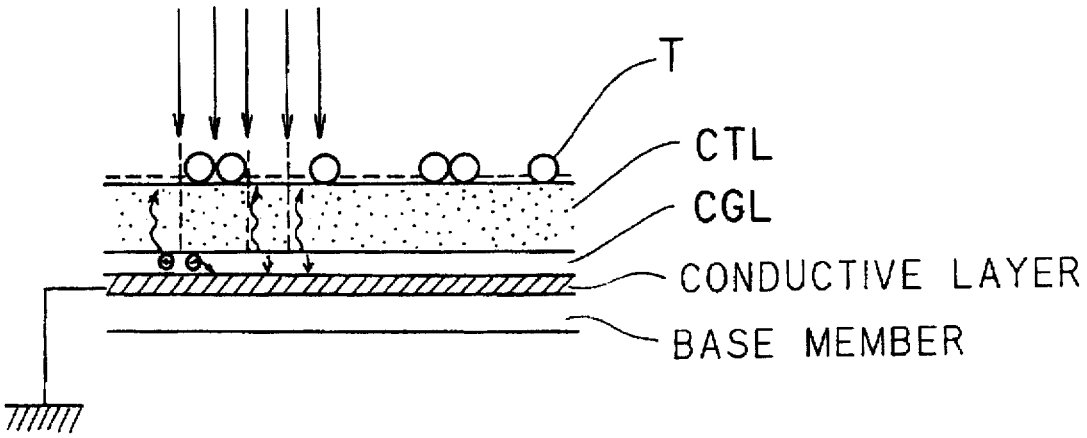
FIG. 13 is a view for illustrating a prior art exposing method.
Figure 14:
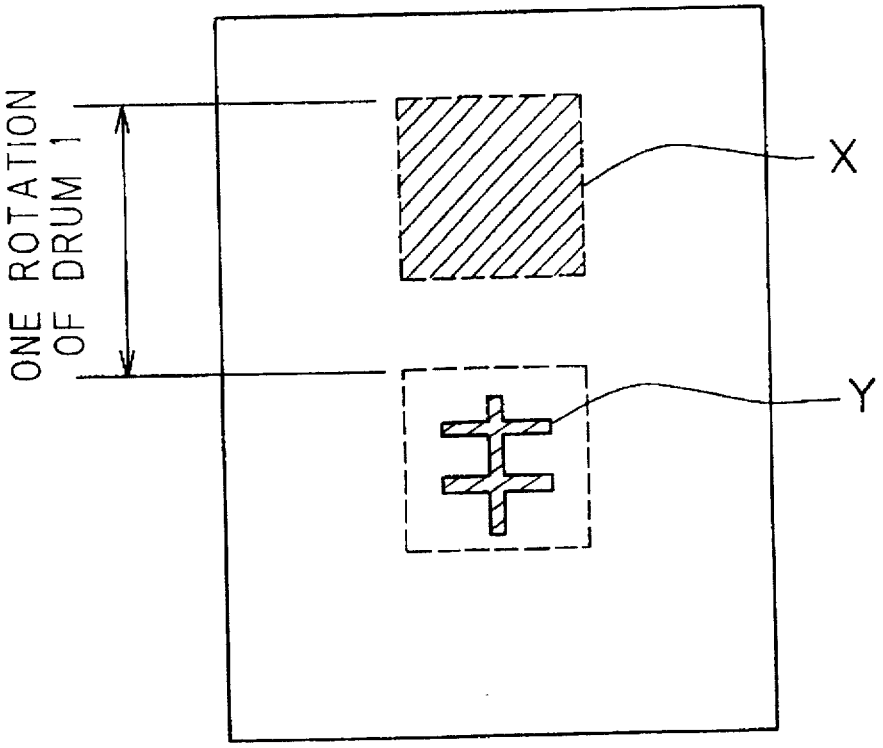
FIG. 14 is a view illustrating an image pattern for determining image forming conditions of a printer.
Figure 15A:
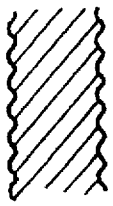
FIGS. 15(A) and 15(B) are views for comparing line image forming conditions under exposure in a printer in FIG. 10 and under conventional exposure.
Figure 15B:
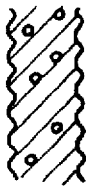

FIG. 14 illustrates patterns to be printed for comparison of the exposure performed from the surface of the photosensitive drum 10 as is done in the prior art, and the exposure from the side of the photosensitive drum base member 11, as is done in this embodiment, so as to clearly recognize the difference therebetween. That is; a black solid image X was printed and subsequently a line image Y was printed. The conditions of the printed line image Y in the embodiment are illustrated in FIG. 15(A) and that in the prior art method is illustrated in FIG. 15(B). The process in which the charge disappears in the embodiment is also illustrated in FIG. 12, and that in the prior art method is illustrated in FIG. 13.

As can be seen from them, when the exposure is performed from the side of the photosensitive drum base member 11, formation of the carrier in the photosensitive layer is effected correspondingly to the exposure amount and the exposure width, as shown in FIG. 12, while, in the prior art method performing the exposure from the photosensitive drum surface, as shown in FIG. 13, the image exposing light tends to be, in some cases, intercepted at a portion bearing the untransferred toner (residual toner) and thus the surface charge may not correctly disappear so that, as shown in FIG. 15(B), a width of the line is reduced as compared with that in the embodiment shown in FIG. 15(A), and the toner partially lacks in the line.

The charging brush 40 has extremely simple structures and does not require an expensive high voltage power supply, which is required in a corona charger, so that the charging and developing unit A1 can be manufactured to have simple structures at a low cost. Further, the charging brush 40 can advantageously prevent the generation of ozone, which may be caused in the corona charger.

Integral construction of the charging brush 40 and the developing section 2 in the form of unit, as is done in this embodiment, allows extremely easy and collective maintenance relating to sticking of the paper powder and others in the charging brush 40, deterioration of the toner in the developing section 2, mixture of the paper powder and supplement of the toner, and thus stable images can be obtained for a long term as a whole.

What is claimed is:

1. An image forming apparatus, comprising:

an endless image carrier which is provided movably in a moving direction, said image carrier including an outer surface having photoconductivity and a transparent inner surface which permits light to pass therethrough so as to cause the photoconductivity of said outer surface;

a charger which is provided on an outer space of said image carrier, said charger contacting with said outer surface for applying a predetermined voltage, which is sufficient for forming latent image onto said image carrier, to said outer surface;

an exposure unit which is provided on an inner space surrounded by the image carrier to confront the inner surface of the image carrier, and is located at a downstream side of said charger with respect to the moving direction of said image carrier, for forming an electrostatic latent image onto said outer surface of the image carrier by exposing with light the image carrier charged by the charger;

a developing device which is provided on the outer space of said image carrier, and is located at a downstream side of said exposure unit with respect to the moving direction of said image carrier, for selectively sticking toner particles to said electrostatic latent image formed by the exposure unit; and a transferring device which provided on the outer space of said image carrier, and is located at a downstream side of said developer with respect to the moving direction of said image carrier, for transferring said toner image formed by the developing device from the image carrier to a recording medium, wherein no cleaner is provided for the image carrier between the transferring device and the charger.

2. The image forming apparatus of claim 1, wherein said electrostatic latent image carrier is chargeable by exposure to a voltage from said charges.

3. An image forming apparatus comprising:

an image carrier provided movably in a moving direction;

a contact charger which is in contact with said image carrier to charge said image carrier to a voltage having a predetermined polarity, said voltage being high enough to form an electrostatic latent image on said image carrier;

an image forming mechanism provided on a downstream side of said charger with respect to the moving direction, said image forming mechanism forming an electrostatic latent image on the charged image carrier; and a developing device provided on the downstream side of said image forming mechanism with respect to the moving direction, said developing device accommodating toner particles and having an element, said element being provided rotatably to carry a layer of the toner particles to a contact position at which said element is in contact with said image carrier through the layer with a predetermined nip width to develop the electrostatic latent image with the toner particles and to collect residual toner particles on said image carrier, said layer having a thickness of 100 μm or less, said toner particles which are carried by said element being charged to a predetermined polarity same as that of the predetermined polarity of the charged image.

4. An image forming apparatus as claimed in claim 3, wherein said element is a sleeve that is elastically deformed at the contact position to make the nip width.

5. An image forming apparatus as claimed in claim 3, wherein said developing device has a regulating member which regulates the thickness of the layer.

6. An image forming apparatus as claimed in claim 3, wherein said developing device accommodates one-component non-magnetic toner particles.

7. An image forming apparatus as claimed in claim 3, wherein said contact charger is a brush charger.

8. An image forming apparatus as claimed in claim 7, wherein said brush charger is fixedly provided.

9. An image forming apparatus as claimed in claim 3, wherein said image forming mechanism includes a laser source.

10. An image forming apparatus as claimed in claim 3, wherein said image carrier and the toner particles are charged to a negative polarity.

11. An image forming apparatus as claimed in claim 3, further comprising means for forming an electrostatic force between said image carrier and said element so as to develop a portion of said image carrier where an image should be developed and to collect the residual toner particles on a portion of said image carrier where images should not be developed.

12. An image forming apparatus as claimed in claim 3, wherein said developing device and said charger are provided in a case which is detachably mounted in said image forming apparatus.

13. An image forming apparatus as claimed in claim 12, wherein said image carrier remains in said image forming apparatus when said case is removed from said image forming apparatus.

14. An image forming apparatus as claimed in claim 3, wherein no cleaning device other than said developing device is provided in said image forming apparatus.

15. An image forming apparatus as claimed in claim 3, wherein the toner particles have a diameter in a range from 3 μm to 15 μm.

16. An image forming apparatus as claimed in claim 3, wherein said element is in contact with said image carrier with a nip width of 1 mm or more.

17. An image forming apparatus as claimed in claim 3, wherein a velocity of said element at the contact position is greater than that of said image carrier at the contact position.

18. An image forming apparatus as claimed in claim 3, wherein said image forming mechanism forms the electrostatic latent image on said image carrier by irradiating light.

19. An image forming apparatus as claimed in claim 18, wherein a portion of said image carrier that is irradiated with the light is developed by the toner particles on said element, and residual toner particles on a portion of said image carrier that is not irradiated with the light is collected by said element.

20. An image forming apparatus as claimed in claim 3, wherein the apparatus is a reverse developing image forming apparatus.

21. An image forming apparatus as claimed in claim 3, wherein said element is a sleeve.

22. An image forming apparatus comprising:

an image carrier provided movably in a moving direction;

a contact charger which is in contact with said image carrier to charge said image carrier to a voltage having a predetermined polarity, said voltage being high enough to form an electrostatic latent image on said image carrier;

an image forming mechanism provided on a downstream side of said contact charger with respect to the moving direction, said image forming mechanism forming an electrostatic latent image on the charged image carrier; and a contact developing device provided on the downstream side of said image forming mechanism, said developing device accommodating toner particles and having an element, said element being provided rotatably to carry a layer of the toner particles to a contact position at which said element is in contact with said image carrier through the layer of the toner particles with a predetermined nip width, the thickness of said layer being 100 μm or less, the toner particles which are carried by said element being charged to the predetermined polarity same as that of the charged image carrier.

23. An image forming apparatus as claimed in claim 22, wherein said developing device has a regulating member which regulates the thickness of the layer of the toner particles carried by said element.

24. An image forming apparatus as claimed in claim 22, wherein said toner particles have a diameter in a range from 3 μm to 15 μm.

25. An image forming apparatus as claimed in claim 22, wherein said element is in contact with said image carrier with a nip width of 1 mm or more.

26. An image forming apparatus as claimed in claim 22, wherein a velocity of said element at the contact position is greater than that of said image carrier at the contact position.

27. An image forming apparatus as claimed in claim 22, wherein said developing device collects residual toner particles from said image carrier, and wherein no device for collecting the residual toner particles on said image carrier other than said developing device is provided in said image forming apparatus.

28. An image forming apparatus as claimed in claim 22, wherein said developing device accommodates one-component non-magnetic toner particles.

29. An image forming apparatus as claimed in claim 22, wherein said element is elastically deformed at the contact position.

30. An image forming apparatus as claimed in claim 22, wherein the apparatus is a reverse developing image forming apparatus.

31. An image forming apparatus as claimed in claim 22, wherein said element is a sleeve.

32. A process cartridge used in and removably attached to a body of an image forming apparatus including an image carrier and an exposing mechanism for forming a reverse electrical latent image onto said image carrier, said image carrier being provided movably in a moving direction, said process cartridge comprising:

a contact charger for contacting an image carrier to charge said image carrier to a voltage having a predetermined polarity, said voltage being high enough to form an electrical latent image on said carrier; and a developing device accommodating toner particles and having an element which is for contacting said image carrier at a contact position through a layer of the toner particles with a predetermined nip width, said element being provided rotatably to carry the layer of the toner particles to a contact position, the thickness of said layer being 100 μm or less, the toner particles which are carried by said element being charged to a predetermined polarity same as that of the charged image carrier.

33. A process cartridge as claimed in claim 32, wherein said developing device is for developing the latent image on said image carrier and for collecting residual toner held on said image carrier.

34. A process cartridge as claimed in claim 32, wherein said image carrier is mounted on said body of said image forming apparatus, and said contact charger and said element are in contact with said image carrier only when said process cartridge is attached to said body of said image forming apparatus.

35. A process cartridge as claimed in claim 32, wherein said element is a sleeve.

36. A process cartridge used in and removably attached to a body of an image forming apparatus including an image carrier and an exposing mechanism for forming an electrical latent image on said image carrier, said image carrier being provided movably in a moving direction, said process cartridge comprising:

a contact charger for contacting an image carrier to charge said image carrier to a voltage high enough to form an electrical latent image on said image carrier; and a developing device accommodating toner particles and having an element which is for contacting said image carrier at a contact position through a layer of the toner particles with a predetermined nip width, said element being provided rotatably to carry the layer of the toner particles to a contact position, the thickness of said layer being 100 μm or less.

37. A process cartridge as claimed in claim 36, wherein said toner particles are charged to a predetermined polarity same as the polarity of the charged image carrier, and the exposing mechanism forms a reverse electrical image on said image carrier.

38. A process cartridge as claimed in claim 37, wherein said developing device is for developing the latent image on said image carrier and for collecting residual toner held on said image carrier.

39. A process cartridge as claimed in claim 36, wherein said image carrier is mounted on said body of said image forming apparatus, and said contact charger and said element are in contact with said image carrier only when said process cartridge is attached to said body of said image forming apparatus.

40. A process cartridge as claimed in claim 36, wherein said element is a sleeve.

41. A developing device, which is used in an image forming apparatus including a contact charger which is in contact with an image carrier to charge said image carrier to a voltage sufficient for forming an electrical latent image on said image carrier and an exposing device for forming an electrical latent image on said image carrier charged by said contact charger, for developing the electrical latent image on the image carrier by toner particles, said developing device comprising:

a cylindrical film-like sleeve, for carrying the toner particles to a contact position at which position said sleeve is in contact with said image carrier, said sleeve having a thickness sufficient for elastic deformation and being elastically deformed at the contact position to form a predetermined nip width;

wherein said sleeve transports the toner particles in a form of a layer with a thickness of 100 μm or less.

42. A developing device as claimed in claim 41, wherein said sleeve is made of nickel.

43. A developing device as claimed in claim 41, wherein a thickness of said sleeve is about 35 μm.

44. A developing device as claimed in claim 41, wherein said predetermined nip width is 1 mm or more.

45. A developing device for developing a latent image formed on an image carrier, comprising:

an element for contacting the image carrier at a contact position, provided rotatably; and a regulator which regulates a thickness of a layer of toner adhered to said element to 100 μm or less;

wherein said element transports the layer of toner to the contact position and is in contact with the image carrier through the layer of toner.

46. The developing device as claimed in claim 45, wherein said developing device is installed in an image forming apparatus which has a contact charger for charging the image carrier to a voltage high enough to form the latent image.

47. The developing device as claimed in claim 45, wherein said element collects residual toner particles from the image carrier at the contact position.

48. A developing device as claimed in claim 45, wherein said element is a sleeve.

* * * * *